US012228148B2

(12) United States Patent
Chen et al.

(10) Patent No.: US 12,228,148 B2
(45) Date of Patent: Feb. 18, 2025

(54) FAN WITH IMPROVED HEAT DISSIPATION PERFORMANCE AND LOW NOISE AND ELECTRONIC DEVICE HAVING THE SAME

(71) Applicant: CHAMP TECH OPTICAL (FOSHAN) CORPORATION, Foshan (CN)

(72) Inventors: Jing-Shu Chen, Foshan (CN); Yong-Kang Zhang, Shenzhen (CN); Yung-Ping Lin, New Taipei (TW)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 180 days.

(21) Appl. No.: 17/826,648

(22) Filed: May 27, 2022

(65) Prior Publication Data

US 2023/0265863 A1 Aug. 24, 2023

(30) Foreign Application Priority Data

Feb. 18, 2022 (CN) ..... 202210152383.9

(51) Int. Cl.

| | |
|---|---|
| ***F04D 29/66*** | (2006.01) |
| ***F04D 17/16*** | (2006.01) |
| ***F04D 29/30*** | (2006.01) |
| ***F04D 29/38*** | (2006.01) |
| ***F04D 29/54*** | (2006.01) |

(52) U.S. Cl.

CPC ..... *F04D 29/663* (2013.01); *F04D 17/16* (2013.01); *F04D 29/30* (2013.01); *F04D 29/388* (2013.01); *F04D 29/541* (2013.01); *F04D 29/666* (2013.01)

(58) Field of Classification Search

CPC ..... F04D 17/16; F04D 29/281; F04D 29/282; F04D 29/283; F04D 29/30; F04D 29/663; F04D 29/666; F04D 29/668; F04D 29/388; F04D 29/541; F05D 2240/301

USPC ..... 416/189

See application file for complete search history.

(56) References Cited

U.S. PATENT DOCUMENTS

| | | | | |
|---|---|---|---|---|
| 6,514,036 | B2 * | 2/2003 | Marshall | F04D 29/666 415/206 |
| 6,537,030 | B1 * | 3/2003 | Garrison | F04D 29/282 416/185 |
| 2002/0057965 | A1 * | 5/2002 | Huang | F04D 29/667 415/102 |
| 2003/0108427 | A1 * | 6/2003 | Chow | F04D 29/328 416/203 |
| 2007/0253808 | A1 * | 11/2007 | Hasan | F04D 29/666 415/119 |
| 2013/0089425 | A1 * | 4/2013 | Wu | F04D 17/162 416/198 R |

(Continued)

*Primary Examiner* — Devon C Kramer
*Assistant Examiner* — Joseph S. Herrmann
(74) *Attorney, Agent, or Firm* — ScienBiziP, P.C.

(57) ABSTRACT

A fan with increased heat-removing ability and reduced noise in operation includes a hub, a baffle, a first blade layer, and a second blade layer. The first blade layer includes a plurality of first blades, and the second blade layer includes a plurality of second blades. An orthogonal projection of each of the plurality of first blades on the baffle is located between orthogonal projections of adjacent two of the plurality of second blades on the baffle. A length of the plurality of first blades is greater or less than a length of the plurality of second blades to avoid any resonance. An electronic device including the fan is also disclosed.

16 Claims, 8 Drawing Sheets

(56) References Cited

U.S. PATENT DOCUMENTS

| | | | | |
|---|---|---|---|---|
| 2013/0129513 | A1* | 5/2013 | Wu | F04D 29/282<br>416/189 |
| 2014/0127029 | A1* | 5/2014 | Yang | F04D 29/281<br>416/223 B |
| 2020/0224672 | A1* | 7/2020 | Lin | F04D 29/4253 |

* cited by examiner

FAN WITH IMPROVED HEAT DISSIPATION PERFORMANCE AND LOW NOISE AND ELECTRONIC DEVICE HAVING THE SAME

FIELD

The subject matter herein generally relates to a fan and an electronic device having the fan.

BACKGROUND

Fans are used in electronic devices to dissipate heat generated by electronic components (such as chips) of the electronic devices. However, the more powerful fans are louder in operation and such noise may become troublesome.

BRIEF DESCRIPTION OF THE DRAWINGS

Implementations of the present disclosure will now be described, by way of embodiments only, with reference to the attached figures.

DETAILED DESCRIPTION

Unless otherwise defined, all technical and scientific terms used herein have the same meaning as commonly understood by persons skill in the art. The terms used herein are only for the purpose of describing specific embodiments, and not intended to limit the embodiments of the present application.

In this application, descriptions such as "first", "second" etc. are only used for description purposes and should not be understood as indicating or implying their relative importance or implying the number of indicated technical features. Thus, a feature defined as "first" and "second" may expressly or implicitly include at least one of that features. In the description of the present application, "plurality" means more than one unless expressly and specifically defined otherwise.

It should be noted that when a component is referred to as being "fixed on" or "mounted on" another component, it may be directly on the other component or there may also be an intervening component. When a component is considered to be "set on" another component, it may be in direct contact with the other component or there may also be an intervening component.

Some embodiments of the present application will be described in detail below with reference to the drawings.

The following embodiments and features of the embodiments may be combined with each other in the absence of conflict.

Figure 1:
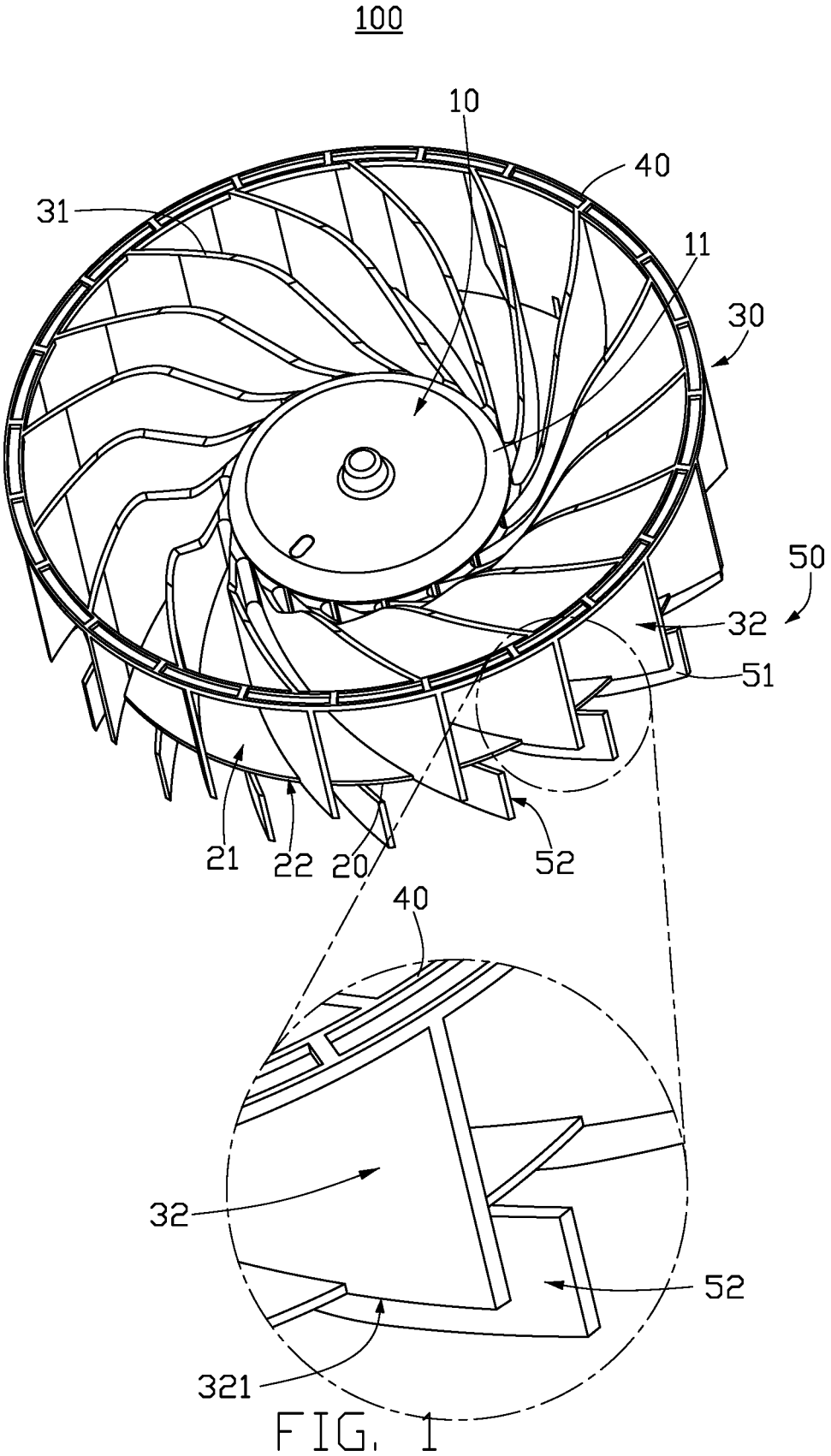
FIG. 1 is a diagrammatic view of a fan according to an embodiment of the present disclosure.
Figure 2:
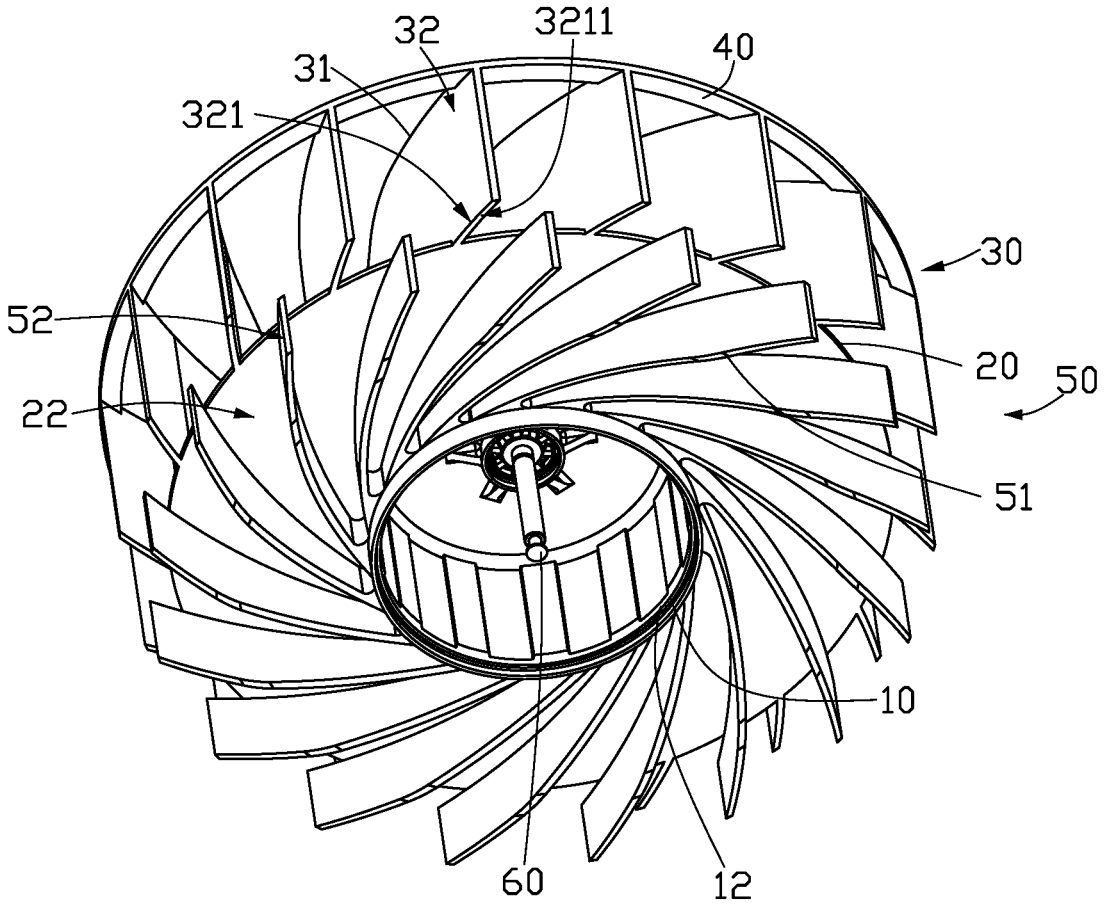
FIG. 2 is similar to FIG. 1, but showing the fan from another angle.

Referring to FIGS. 1 and 2, a fan 100 is provided according to an embodiment of the present disclosure. The fan 100 includes a hub 10, a baffle 20, a first blade layer 30, and a second blade layer 50. The baffle 20 may be an annular plate, and is fixed to a middle of an outer circumference of the hub 10. The hub 10 is divided into a first part 11 and a second part 12 located on both sides of the baffle 20. The baffle 20 has a first surface 21 and a second surface 22 opposite to the first surface 21. The first blade layer 30 is arranged on the first surface 21 of the baffle 20, and the second blade layer 50 is arranged on the second surface 22 of the baffle 20.

Figure 3:
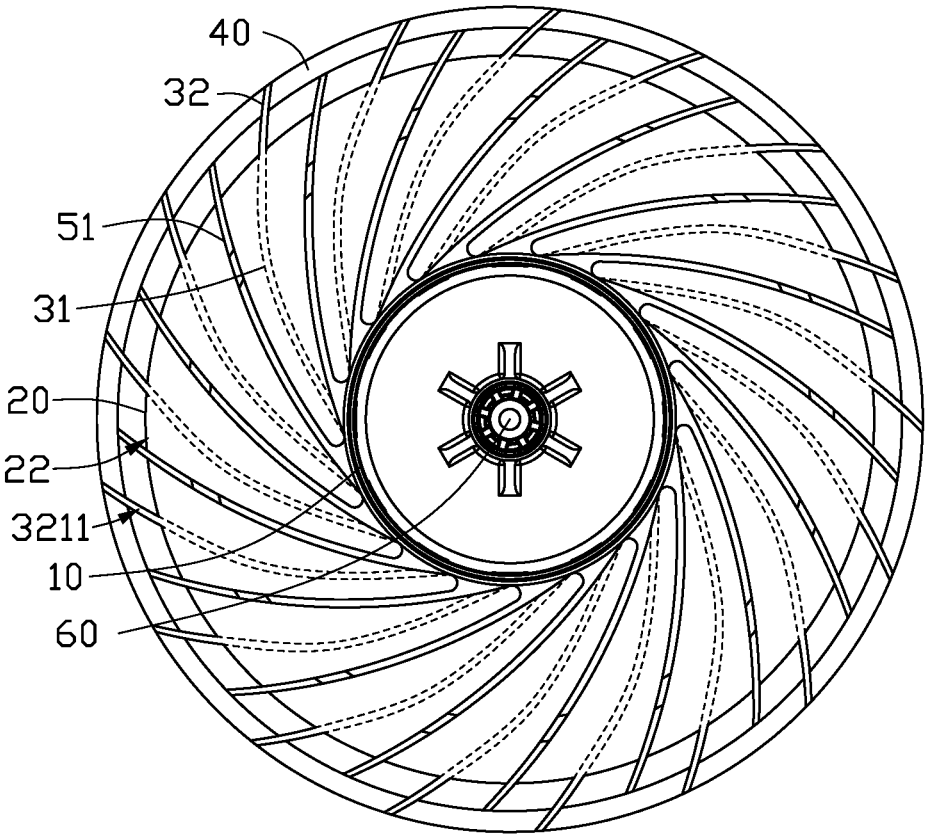
FIG. 3 is a bottom view of the fan of FIG. 1.

Referring to FIGS. 1 to 3, the first blade layer 30 includes a plurality of first blades 31. The first blades 31 are arranged on the first surface 21 at equal intervals, and one end of each first blade 31 is fixed on the first part 11 of the hub 10. The second blade layer 50 includes a plurality of second blades 51. The second blades 51 are arranged on the second surface 22 at equal intervals, and one end of each second blade 51 is fixed to the second part 12 of the hub 10. Thus, the field of flowing air is uniform around the fan 100, so that the fan 100 can uniformly dissipate heat from a device to be cooled.

In other embodiments, the distances between two adjacent first blades 31 may be different from each other, which can make the natural frequency of the first blade layer 30 different from the natural frequency of the second blade layer 50, thereby reducing the noise generated by the fan 100. The distances between two adjacent second blades 51 may also be different from each other. In some embodiments, the distances between two adjacent first blades 31 or the distances between two adjacent second blades 51 may be adjusted to adjust the airflow field around the fan 100, the natural frequency of the first blade layer 30 or the second blade layer 50, and thus the noise of the fan 100.

Referring to FIGS. 1 to 3, the orthogonal projection of each first blade 31 on the baffle 20 is located between the orthogonal projections of two adjacent second blades 51 on the baffle 20. That is, the first blades 31 and the second blades 51 are staggered from each other. Thus, when the first blade layer 30 and the second blade layer 50 rotate coaxially, the airflow fields of the first blade layer 30 and the second blade layer 50 do not interfere with each other. That is, the turbulence of the airflow field at the connection of the outer periphery of the first blade layer 30 and the second blade layer 50 is avoided, eddy currents are minimal, and the heat dissipation performance of the fan 100 is improved.

Referring to FIGS. 2 and 3, the length of the first blade 31 is different from that of the second blade 51. In this way, when the first blade layer 30 and the second blade layer 50 rotate coaxially, the first blade layer 30 and the second blade layer 50 have different natural frequencies, so as to reduce resonance between the first blade layer 30 and the second blade layer 50, and further reduce the overall noise generated by the fan 100. In some embodiments, the length of the first blade 31 may be greater than the length of the second blade 51. In other embodiments, the length of the first blade 31 may be less than the length of the second blade 51.

Referring to FIGS. 1 and 2, in some embodiments, the number of the first blades 31 is the same as the number of the second blades 51, this number may be adjusted according to requirements. In this embodiment, the number of the first blades 31 and the number of the second blades 51 are the same. When the fan 100 rotates, the first blade layer 30 and the second blade layer 50 have a same volume of air supply. In other embodiments, the number of the first blades 31 is different from the number of the second blades 51, so that the first blade layer 30 and the second blade layer 50 have different natural frequencies, thereby reducing resonance between the first blade layer 30 and the second blade layer 50, and also reducing the noise generated by the fan 100.

Figure 5:
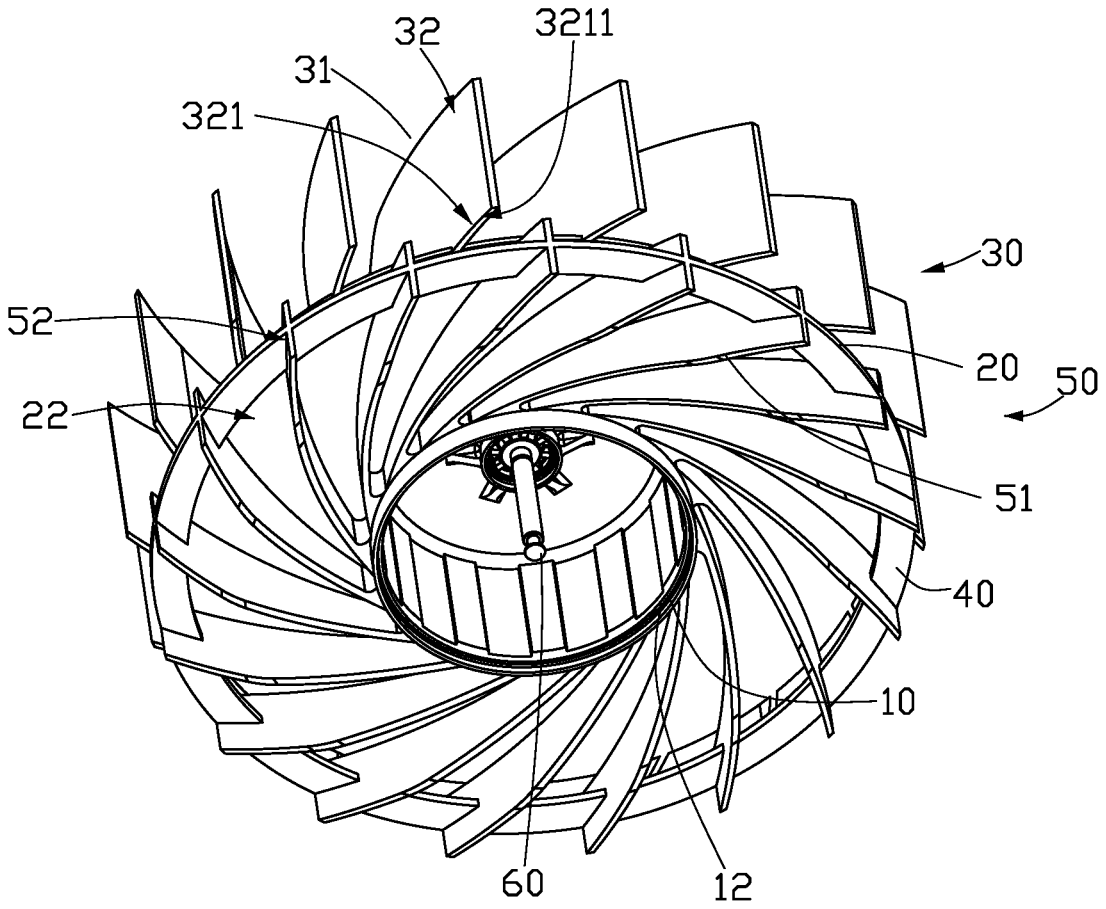
FIG. 5 is a diagrammatic view of a fan according to yet another embodiment of the present disclosure.

Referring to FIGS. 1 and 5, in some embodiments, the fan 100 further includes a mute ring 40. As show in FIG. 1, the mute ring 40 is located at an end of the plurality of first blades 31 away from the hub 10, and is located at a side of the first blades 31 away from the baffle 20 (i.e., located at an upper end of the first blade 31 away from the hub 10 in FIG. 1). The first blades 31 are connected to the mute ring 40, thus the rotation of the first blades 31 is more stable, reducing vibration and thus noise. At the same time, the mute ring 40 also works to reduce deformation caused by the rotation of the first blade 31, so as to ensure the stability of the air supply.

Figure 4:
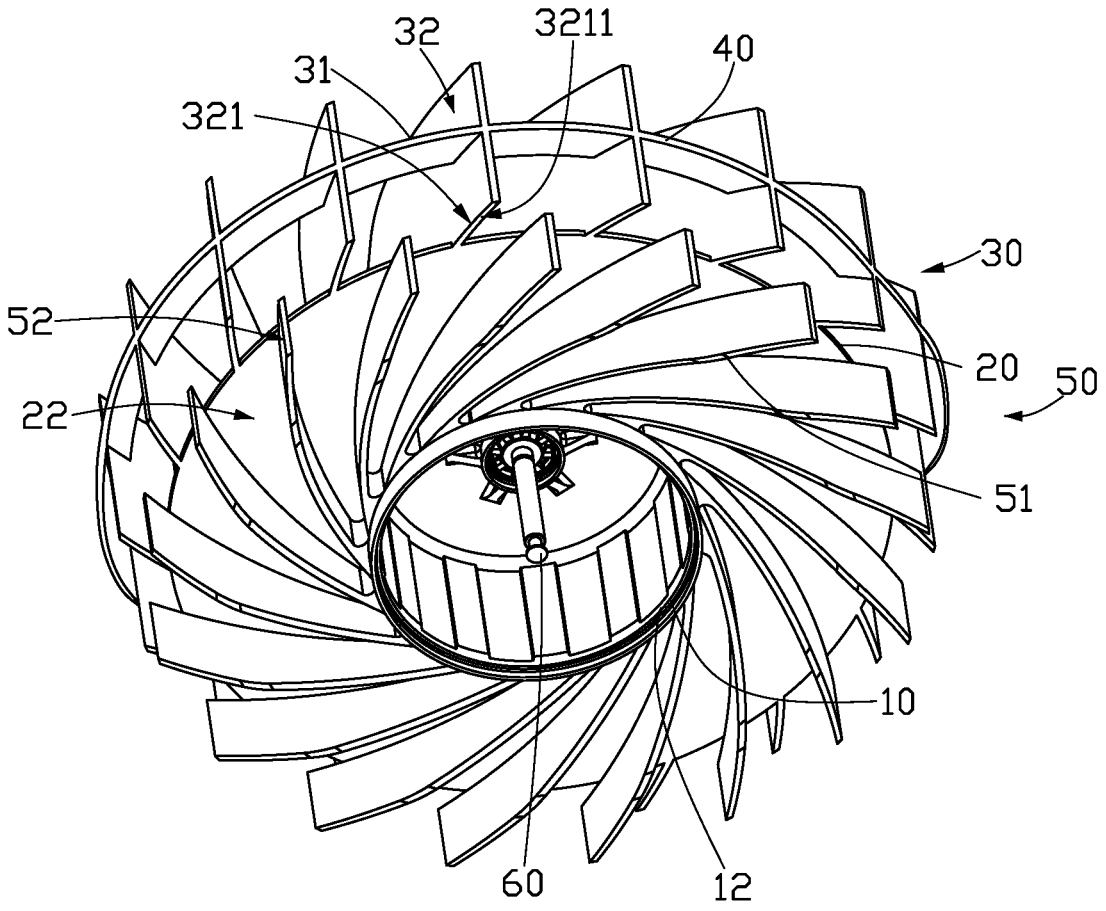
FIG. 4 is a diagrammatic view of a fan according to another embodiment of the present disclosure.

Referring to FIG. 4, in other embodiments, the mute ring 40 may be disposed between the first part 11 and the other end of the first blade 31 away from the first part 11. Referring to FIG. 5, in other embodiments, the mute ring 40 may be disposed on the second blades 51. The position of the mute ring 40 is not limited herein.

Referring to FIGS. 1 and 2, in some embodiments, the hub 10, the baffle 20, the first blade layer 30, and the second blade layer 50 are integrally formed by injection molding. In some embodiments, the fan 100 may also include more than two blade layers. For the blade layers of more than two layers, a modular approach may be taken, that is, each blade layer is prepared by injection molding and then combined to form the fan 100. The production method of the fan 100 can be adjusted according to specific production requirements.

Referring to FIGS. 1 and 2, in some embodiments, an end of the first blade 31 away from the hub 10 extends out of the baffle 20 to form a first extension portion 32. An end of the second blade 51 away from the hub 10 extends out of the baffle 20 to form a second extension portion 52. The orthographic projection of each second extension portion 52 on the first blade layer 30 is located between adjacent first extension portions 32. The arrangement of the first extension portion 32 and the second extension portion 52 is convenient for processing and preparation. Along a direction from the first blade layer 30 to the second blade layer 50, the first extension portion 32 extends toward the baffle 20 to form a protruding portion 321. The protruding portion 321 is fixed on a side wall of the baffle 20. The protruding portion 321 increases the stability of the connection between the first blade 31 and the baffle 20.

Referring to FIGS. 1 and 2, in some embodiments, along the direction from the first blade layer 30 to the second blade layer 50, the protruding portion 321 has a connecting surface 3211. The connecting surface 3211 is a bottom surface of the protruding portion 321 facing the second blade layer 50. The connecting surface 3211 is coplanar with the second surface 22, which will not affect the air outlet from the second extension portion 52 and the baffle 20, and can also ensure the stability of the connection to the baffle 20.

Referring to FIGS. 2 and 3, in some embodiments, the fan 100 further includes a rotating shaft 60. The rotating shaft 60 is fixed in the hub 10 along the direction from the first blade layer 30 to the second blade layer 50. The hub 10 is also provided with a motor (not shown), the motor drives the rotating shaft 60 to rotate, so as to drive the hub 10 to rotate, thereby realizing the rotation of the fan 100.

Example 1

The fan in Example 1 is the above-mentioned fan 100. A length from an end of the first blade 31 connected to the first part 11 to the first extension portion 32 is about 119 mm, and a length from an end of the second blade 51 connected to the second part 12 to the second extension portion 52 is about 113 mm. The difference between the two lengths is about 6 mm.

Comparative Example 1

The fan in Comparative Example 1 is a fan of related art (not shown). In the fan of Comparative Example 1, the orthographic projection of a first blade on a baffle overlaps with that of a second blade. That is, the distance between adjacent first blades is equal to the distance between adjacent second blades, and the length of the first blade is the same as that of the second blade. The other structures are the same as those of Example 1.

Under the same conditions, the speed-sound pressure level curve and the air volume-static pressure curve of the fan in Comparative Example 1 and the fan 100 in Example 1 are each tested.

Figure 6:
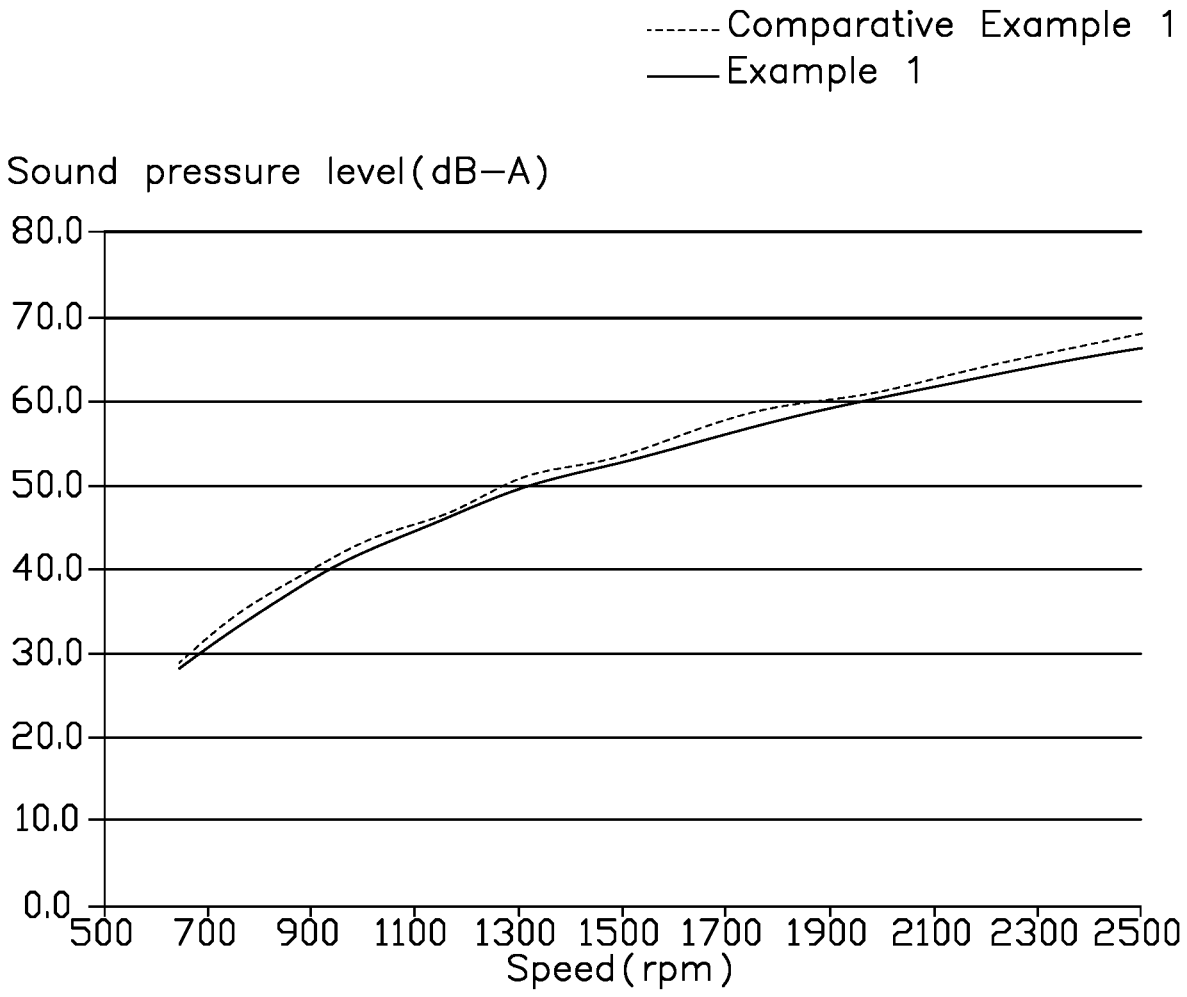
FIG. 6 shows curves of sound pressure levels with respect to speeds of fans in Example 1 and Comparative Example 1.

Referring to FIG. 6, at one fixed speed, the higher the sound pressure level, the greater is the noise. At a same speed, the sound pressure level of the fan 100 provided in Example 1 is always lower than the sound pressure level of the fan in Comparative Example 1, showing that the dislocation of the first blade 31 and the second blade 51, and the different lengths of the first blade 31 and the second blade 51, reduce the noise generated by the fan 100.

Figure 7:
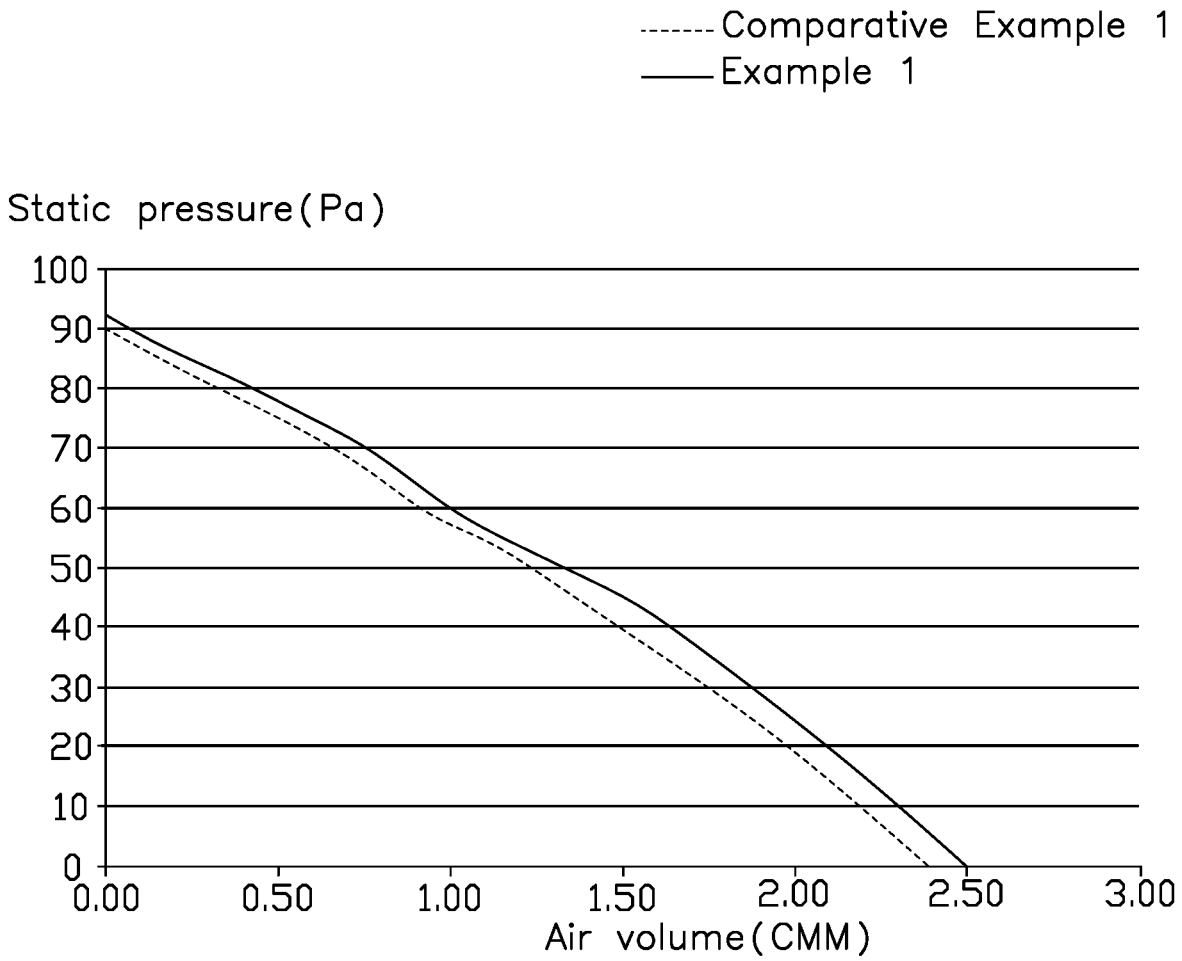
FIG. 7 shows curves of static pressures with respect to air volumes of the fans in Example 1 and Comparative Example 1.

Referring to FIG. 7, under a same air volume, the higher the static pressure, the better the cooling effect of the fan 100. For the same air volume, the static pressure of the fan 100 provided in Example 1 is always greater than that of the fan in Comparative Example 1, which reveals that the fan 100 in Example 1 will more quickly and efficiently draw heat away from a surface.

In the present application, the first blades 31 and the second blades 51 are staggered from each other, and the lengths of the first blades 31 and the second blades 51 are different, improving the heat dissipation performance and reducing the probability of resonance between the first blade layer 30 and the second blade layer 50.

Figure 8:
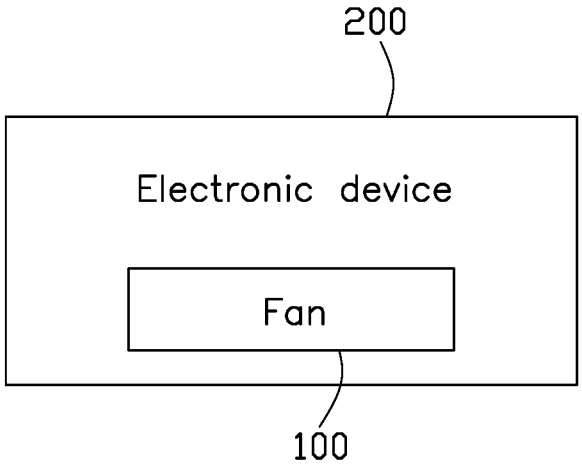
FIG. 8 is a diagrammatic view of an electronic device according to an embodiment of the present disclosure.

Referring to FIG. 8, the present application also provides an electronic device 200 including the above-mentioned fan 100. The fan 100 is configured for dissipating heat generated within the electronic device 200.

The above descriptions are some specific embodiments of the present application, but the actual application process cannot be limited only to these embodiments. For those of ordinary skill in the art, other modifications and changes made according to the technical concept of the present application should all belong to the protection scope of the present application.

What is claimed is:

1. A fan comprising:

a hub;

a baffle fixed to an outer circumference of the hub, the baffle comprising a first surface radially outward extending from the hub and a second surface radially outward extending from the hub and opposite to the first surface, and the hub comprising a first part located above the first surface and a second part located above the second surface;

a first blade layer comprising a plurality of first blades, the plurality of first blades arranged on the first surface at intervals, and an end of each of the plurality of first blades connected to the first part, another end of each of the plurality of first blades facing away from the hub radially outward extending out of the baffle to form a first extension portion; and a second blade layer comprising a plurality of second blades, the plurality of second blades arranged on the second surface at intervals, and an end of each of the plurality of second blades connected to the second part; an orthogonal projection of a portion of each of the plurality of first blades on the baffle located between orthogonal projections of adjacent two of the plurality of second blades on the baffle; a length of the plurality of first blades being greater or less than a length of the plurality of second blades, wherein along a direction from the first blade layer to the second blade layer, the first extension portion extends toward the baffle to form a protruding portion, and the protruding portion is fixed on the baffle and has a connecting surface facing away from the first surface, and the connecting surface is coplanar with the second surface.

2. The fan of claim 1, further comprising a mute ring, wherein the mute ring is arranged at the another end of each of the plurality of first blades away from the hub, and the mute ring is arranged at a side of the plurality of first blades away from the baffle.

3. The fan of claim 1, further comprising a mute ring, wherein the mute ring is arranged between the first part and the another end of each of the plurality of first blades away from the first part.

4. The fan of claim 1, further comprising a mute ring, wherein the mute ring is arranged on the plurality of second blades.

5. The fan of claim 1, wherein a distance between each adjacent two of the plurality of first blades is the same.

6. The fan of claim 1, wherein a distance between each adjacent two of the plurality of first blades is different from each other.

7. The fan of claim 1, wherein a number of the plurality of first blades is the same as that of the plurality of second blades.

8. The fan of claim 1, wherein a number of the plurality of first blades is different from that of the plurality of second blades.

9. The fan of claim 1, wherein the hub, the baffle, the first blade layer, and the second blade layer are integrally formed.

10. The fan of claim 1, wherein another end of each of the plurality of second blades away from the hub extends out of the baffle to form a second extension portion, and the second extension portion of each of the plurality of second blades is located between the first extension portions of adjacent two of the plurality of first blades on the baffle when viewed along an axis of the fan.

11. An electronic device comprising a fan, the fan comprising:

a hub;

a baffle fixed to an outer circumference of the hub, the baffle comprising a first surface radially outward extending from the hub and a second surface radially outward extending from the hub and opposite to the first surface, and the hub comprising a first part located above the first surface and a second part located above the second surface;

a first blade layer comprising a plurality of first blades, the plurality of first blades arranged on the first surface at intervals, and an end of each of the plurality of first blades connected to the first part, another end of each of the plurality of first blades facing away from the hub radially outward extending out of the baffle to form a first extension portion; and a second blade layer comprising a plurality of second blades, the plurality of second blades arranged on the second surface at intervals, and an end of each of the plurality of second blades connected to the second part; an orthogonal projection of each of the plurality of first blades on the baffle located between orthogonal projections of adjacent two of the plurality of second blades on the baffle; a length of the plurality of first blades being greater or less than a length of the plurality of second blades, wherein along a direction from the first blade layer to the second blade layer, the first extension portion extends toward the baffle to form a protruding portion, and the protruding portion is fixed on the baffle and has a connecting surface facing away from the first surface, and the connecting surface is coplanar with the second surface.

12. The electronic device of claim 11, wherein another end of each of the plurality of second blades away from the hub extends out of the baffle to form a second extension portion, and the second extension portion of each of the plurality of second blades is located between the first extension portions of adjacent two of the plurality of first blades on the baffle when viewed along an axis of the fan.

13. The electronic device of claim 11, wherein the fan further comprises a mute ring, the mute ring is arranged at the another end of each of the plurality of first blades away from the hub, and the mute ring is arranged at a side of the plurality of first blades away from the baffle.

14. The electronic device of claim 11, wherein the fan further comprises a mute ring, the mute ring is arranged between the first part and the another end of each of the plurality of first blades away from the first part.

15. The electronic device of claim 11, wherein the fan further comprises a mute ring, the mute ring is arranged on the plurality of second blades.

16. The electronic device of claim 11, wherein a distance between each adjacent two of the plurality of first blades is the same.

* * * * *